United States Patent [19]

McLaughlin

[11] 4,096,654

[45] Jun. 27, 1978

[54] DRAG IMPLEMENT FOR GATHERING AND SPREADING DIRT

[76] Inventor: Henry Felton McLaughlin, 3925 Sand Ridge Dr., Gautier, Miss. 39553

[21] Appl. No.: 834,071

[22] Filed: Sep. 19, 1977

[51] Int. Cl.[2] ..... E02F 3/00

[52] U.S. Cl. ..... 37/118 R; 37/140; 214/766

[58] Field of Search ..... 37/118 R, 118 A, 117.5, 37/103, 124, 134, 137–140; 214/140, 766, 770, 773; 172/272, 439, 449

[56] References Cited

U.S. PATENT DOCUMENTS

| | | | |
|---|---|---|---|
| 1,510,824 | 10/1924 | Bird | 37/124 |
| 1,843,266 | 2/1932 | Bird | 37/140 |
| 1,843,339 | 2/1932 | Reynolds | 37/140 |
| 1,852,062 | 4/1932 | Reynolds | 37/140 |
| 1,862,903 | 6/1932 | Olinger | 37/140 |
| 2,109,394 | 2/1938 | Livingston | 37/140 |
| 2,514,169 | 7/1950 | Tidwell | 37/140 |
| 2,634,517 | 4/1953 | Zink | 37/140 |
| 2,760,284 | 8/1956 | Cook | 37/124 |
| 3,319,367 | 5/1967 | Lewis | 37/118 R |
| 3,912,092 | 10/1975 | Bolton et al. | 214/767 X |

FOREIGN PATENT DOCUMENTS

| | | | |
|---|---|---|---|
| 147,562 | 9/1951 | Australia | 37/124 |

*Primary Examiner*—E. H. Eickholt

*Attorney, Agent, or Firm*—James B. Lake, Jr.

[57] ABSTRACT

A dirt gathering and hauling bucket is pivotally attached to manually operable lift arms mounted to extend rearwardly on the back end of a riding garden tractor to swing level with open top and front, and a leading sharp edge defined forwardly by a closed bottom. A pair of transverse elements, vertically spaced apart, are mounted adjacent the forward upper edge of the bucket to loosely receive therethrough the free end of a jam bar that is pivoted by its other end to the rear of the garden tractor between the lift arms. The difference between the vertical dimension of the jam bar and the vertical space between transverse elements determines the angle of tilt of the bucket and its leading sharp edge as it engages the ground, when lowered by the lift arms, by the jam bar jamming between the transverse elements to stop the bucket's rearward pivoting. The upper transverse element is releasable, after raising the bucket, to dump it by pivoting, unrestrained by the released jam bar, around the ends of the lift arms. The free end of the jam bar engages a bracket mounted on the back of the bucket when the bucket is pivoted for the leading sharp edge to be normal with the ground to spread the dumped dirt. All operations of the drag implement are done from the seat of the riding garden tractor except engaging the free end of the jam bar to the back of the bucket.

4 Claims, 3 Drawing Figures

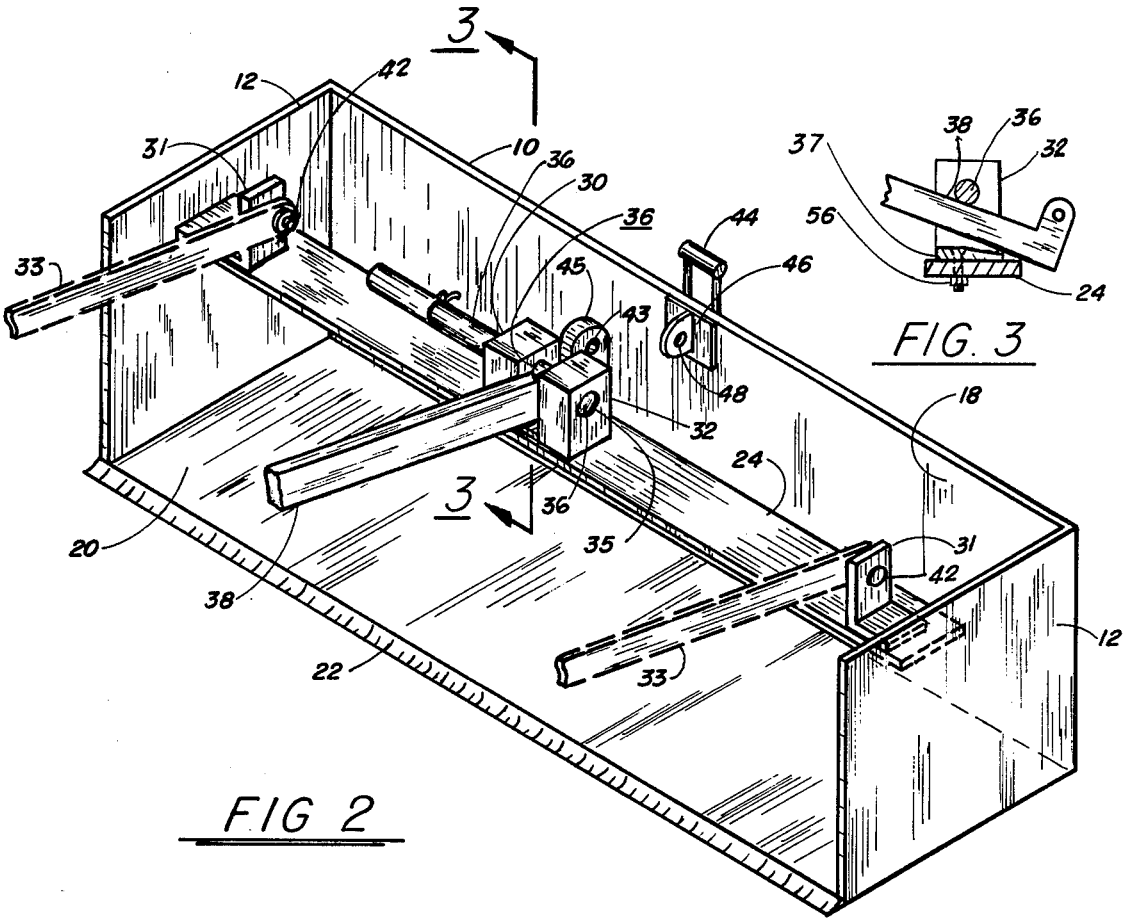
FIG 2
FIG. 3
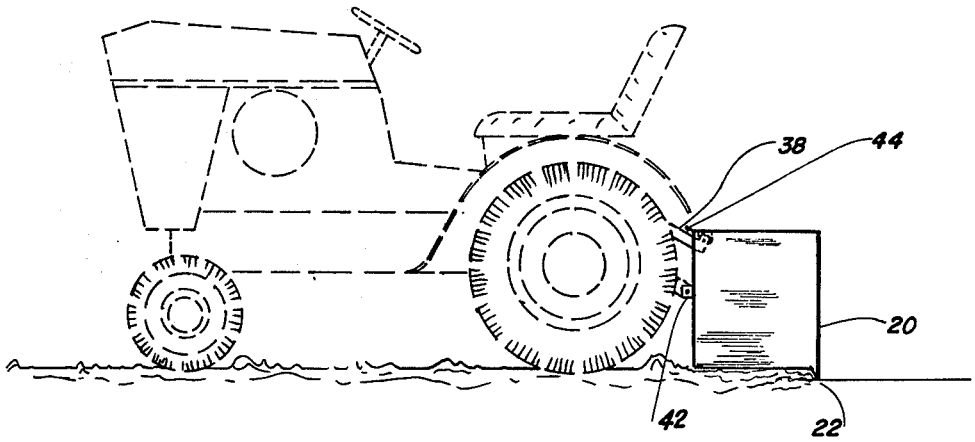
FIG. 1

DRAG IMPLEMENT FOR GATHERING AND SPREADING DIRT

BACKGROUND OF THE INVENTION

The invention generally relates to garden implements for grading gardens, and more particularly to gathering of dirt and the dispersal thereof by spreading.

It is well known in the art for a riding garden tractor to power snow plows, scraper blades, and scoop pans by pushing, either to the front or rear, but not by dragging. The difficulty heretofore unresolved satisfactorily was to stabilize the tilt angle or angle of attack of the sharp edge of the bucket to gather dirt within the limit of available power of the tractor and strength of the drag implement, and to dump the gathered dirt when and where desired.

SUMMARY OF THE INVENTION

It is an object of the invention to provide a drag implement for use with a riding garden tractor to grade and level a garden.

It is a further object of the invention to provide a bucket, for gathering, hauling and dumping dirt, that can be converted into a spreader of the dumped dirt.

Another object of the invention is to provide means for stabilizing the angles of tilt of a dirt gathering bucket in two positions within the power and material strength of the drag implement and to conform the angles to two different sizes of tractor.

BRIEF DESCRIPTION OF THE DRAWINGS

FIG. 1 is a side elevation of the invention installed on a garden tractor with bucket inverted and sharp edge normal to the ground for spreading dirt;

FIG. 2 is a three-dimensional view of the invention from the front upper right in normal carrying position; and FIG. 3 is a sectional view of FIG. 2 taken along section lines 3—3 partially showing the jam bar engaged for gathering dirt and a reversibly mounted wedge for setting tilt angles on different sizes of tractors.

DETAILED DESCRIPTION OF THE INVENTION

Referring to FIGS. 1-3, the invention comprises a rectangular bucket 10, open at the front and top, with two side walls 12, a back wall 18, and a bottom 20. A leading sharp edge 22 is defined forwardly by bottom wall 20. A first transverse element 24 extends across the top of container 10 between end walls 12 and supports a jam bar lock assembly 30 centered between said end walls 12. Two mounting brackets 31, fixed to the ends of first transverse element 24, are pivotally connected to manually operable lift arms 33 of said garden tractor. Lock assembly 30 includes two longitudinally spaced end blocks 32 respectively defining aligned holes 35 in which a lock pin 36, a second transverse element, is slidable. A wedge 37 is bolted to said first transverse element 24 between said spaced end blocks 32. A center space is defined between end blocks 32, first transverse element and the wedge, if used, and lock pin 36 when slidably engaging both end blocks 32 has variable vertical dimensions depending on whether or not the wedge is bolted to said first transverse element and the orientation of the wedge slope. A jam bar 38 with oppositely disposed ends is pivotally connected at one end to the back and center of the garden tractor. The other free end 45 extends through the space defined by the lock assembly 30 and the first transverse element and is jammed between the lock pin 36 and opposing structure by the rotation of the bucket 10 when it is lowered by lift arms 33 to engage the ground for gathering dirt. The ratio of the vertical dimension of the jam bar to the vertical height of the space determines the tilt angle of the bucket and its leading sharp edge 22 in said jamming action. This ratio is variable by reversing or removing the wedge from between the end blocks 32 and on the first transverse element 24 by unbolting the wedge. The variation in space height provides also for use with a variety of garden tractors of different hitch heights above the ground while maintaining a desired tilt angle of the bucket. When the bucket is raised by the lift arms, it pivots to its normal level position without tilt.

A handle 44 extending above the back wall 18 and fixed thereto is used for pivoting the bucket upside down for dumping, the lock pin 36 first being slidably disengaged from one of end blocks 32 to open said center space defined therebetween. A converter bracket 46, defining a hole 48, is mounted below handle 44 and in the interior of the bucket for connecting with the free end 45 of the jam bar 38 in which an aligned hole 43 is defined by a common pin (not shown) passing therethrough. The length of the jam bar is adapted, when pinned to the back of the bucket, to rigidly position the inverted bucket with its sharp edge normal to the ground for acting as a spreader when lowered to engage said ground.

What is claimed is:

1. A drag implement for use with a garden tractor having horizontally spaced lift arms extending rearwardly therefrom for raising and lowering the free ends thereof, and comprising:

a. a rectangular bucket means having closed back, bottom and sides, and open front, and an open top, said bottom having a leading sharp edge for gathering dirt, and said bucket for pivotally suspending on the raised free ends of said rearwardly extending lift arms with open top up and said leading sharp edge parallel with the ground;

b. a first transverse element means fixed across said open top, adjacent said open front, for transversely bracing said closed sides;

c. jam bar assembly means center mounted on said first transverse element means, and having a second transverse element means slidably supported above said first transverse element means, for defining an openable and closable center space between said transverse element means;

d. jam bar means, having a vertical dimension less than the height of said center space, pivotally mounted on the back of said garden tractor and adapted for a free end thereof to extend through said center space for jamming between said first and closed second transverse elements means, responsive to said leading sharp edge of said bucket bottom, when lowered, engaging the ground to pivot said bucket and edge to an angle of tilt limited by the ratio of said center space vertical dimension to said jam bar means vertical dimension; and e. converter link means mounted on the back of said bucket for pivotally engaging the free end of said jam bar means with said second transverse element means open and said bucket is pivoted with the bottom and leading sharp edge normal to the ground for acting as a spreader of dirt.

2. A drag implement as described in claim 1 wherein said jam bar assembly means comprises:

a. end blocks oppositely spaced from the middle of said first transverse element means and fixed thereto to horizontally define said center space, and to define aligned holes respectively therethrough for slidably mounting said second transverse means to open and close said center space; and b. wedge means reversibly mountable in said center space and under said jam bar means extending therethrough for varying said center space vertical dimension and thereby the tilt angle of the bucket and leading sharp edge for gathering more or less dirt, and for attaching said drag implement to different sizes of garden tractors without exceeding a desired range of tilt angles.

3. A drag implement as described in claim 1 wherein said converter link means comprises a bracket mounted on the back of said bucket for engaging the free end of said jam bar means and converting said pivotable bucket to a spreader.

4. A drag implement as described in claim 1 wherein a handle is fixed to the top of said closed back for use in manually pivoting said bucket upside down to dump the contents thereof, and for engaging the free end of said jam bar means to said converter link means.

* * * * *